United States Patent [19]

Faure

[11] Patent Number: 4,661,154

[45] Date of Patent: Apr. 28, 1987

[54] PROCESS FOR THE PRODUCTION BY POWDER METALLURGY OF COMPONENTS SUBJECTED TO FRICTION

[75] Inventor: Jean-François Faure, Voiron, France

[73] Assignee: Cegedur Societe de Transformation de l'Aluminum Pechiney, Voreppe, France

[21] Appl. No.: 822,523

[22] Filed: Jan. 27, 1986

[30] Foreign Application Priority Data

Feb. 1, 1985 [FR] France ..... 85 01856

[51] Int. Cl.[4] ..... C22C 29/00

[52] U.S. Cl. ..... 75/231; 75/235; 75/236; 419/10; 419/13; 419/14; 419/16; 419/17; 419/19; 419/23; 419/64; 419/66; 419/67

[58] Field of Search ..... 419/17, 10, 19, 13, 419/67, 14, 66, 16, 23, 64; 75/231, 249, 235, 236, 951

[56] References Cited

U.S. PATENT DOCUMENTS

| | | | |
|---|---|---|---|
| 4,099,314 | 7/1978 | Perrot et al. | 419/17 |
| 4,297,136 | 11/1981 | Pickens et al. | 419/19 |
| 4,315,777 | 2/1982 | Nadkarni et al. | 419/19 |
| 4,463,058 | 7/1984 | Hood et al. | 419/17 |
| 4,557,893 | 12/1985 | Jatkar et al. | 419/19 |
| 4,579,587 | 4/1986 | Grant et al. | 419/66 |

*Primary Examiner*—Stephen J. Lechert, Jr.

*Attorney, Agent, or Firm*—Oblon, Fisher, Spivak, McClelland & Maier

[57] ABSTRACT

A process for the production by power metallurgy of a material based on an aluminum alloy, a solid lubricant and at least one ceramic is disclosed. The process is characterized by using a ceramic in powder form with a granulometry of between 1 and 10 μm.

This invention finds application in the manufacture of components which are subjected to friction, in particular under hot condition, such as engine liners. These components provide an optimum compromise coefficient of friction and resistance to seizure and wear.

11 Claims, No Drawings

PROCESS FOR THE PRODUCTION BY POWDER METALLURGY OF COMPONENTS SUBJECTED TO FRICTION

BACKGROUND OF THE INVENTION

1. Field of the Invention:

The present invention relates to a process for the production of a material intended for the manufacture of components which are subjected to friction.

2. Discussion of the Background

One skilled in the art is aware that components which are subjected to friction must have a certain number of properties. The main properties are as follows:

- a low coefficient of expansion and friction,
- adequate resistance to seizure and wear,
- good machineability,
- a good level of performance with respect to the components against which they rub and which are referred to as "opposing components", in such a way as to limit their wear, and
- good mechanical strength when the components involved are engine liners.

Unfortunately, in the area of components subjected to friction, most of the conventional aluminum alloys are at a particular disadvantage due to their relatively high coefficient of expansion, their strong tendency to seizure and wear, and their high coefficient of friction.

It is for that reason that, when there has been a desire to use aluminum for the manufacture of components which are subjected to friction, attention has been directed towards aluminum-silicon alloys. Aluminum-silicon alloys have coefficients of expansion which are lower than that of other alloys which makes them attractive for components which move in relation to each other with close and controlled clearance and where the temperature varies in the course of operation.

Moreover, aluminum-silicon alloys have the advantage that, when they contain silicon in a hypereutectic amount, production by casting gives rise to the formation of hard primary crystals of silicon which are distributed in a softer aluminum matrix. This increases resistance to wear and to seizure. However, when such crystals are formed in a cast alloy mass, they are generally coarse and make it difficult to machine components.

It is for that reason that, in their French patent publication No. 2,343,895, the present inventors recommended producing such alloys from powders produced by atomisation. In that way, by virtue of the high rates of cooling achieved in production, it is possible to form silicon crystals which are smaller than 20 μm in size. When these powders are shaped by extrusion or by sintering, they give rise to the formation of components which can be machined more easily and which also have an improved coefficient of friction.

This procedure also lends itself favorably to incorporating into the alloy lubricating products, such as graphite or tin or hardening agents such as for example silicon carbide. And is also possible to increase the mechanical strength of such alloys by adding other additive elements such as copper, magnesium, etc.

Subsequently, in their French patent publication No. 2,528,910, the inventors proposed novel improvements in the components produced with such alloys, by the powder metallurgy method. They found in fact that such atomised silicon-aluminum alloys contained a large proportion of silicon particles of smaller size than 5 μm.

And that the latter, because of their high degree of fineness, were detrimental to good compatibility as between relatively moving components. To solve that problem, the inventors set forth the teaching of using mixtures of powders of aluminum and grains of silicon which were carefully calibrated in a granulometry range of between 20 and 50 μm.

More recently new composite materials, which are still produced from aluminum alloy powders, but which incorporate products referred to as "ceramic" have appeared. The term "ceramic" includes in particular corundum, silicon carbide and zirconia. Such materials are set forth in Japanese patent application No. 59/38350 which claims a sintered aluminum alloy containing 0.5 to 30% of solid lubricant (lead, graphite, molybdenum or tungsten sulphide, copper sulphate and boron nitride); 0.2 to 20% of a hard phase ($SiO_2$, $Al_2O_3$, $ZrO_2$, and carbides and nitrides of the same elements); 0.2 to 20% of hardening elements (copper, magnesium, silicon, tin and zinc); and 0.2 to 20% of Fe, Ni or Cr to improve resistance to wear.

It is known that the presence of a hard phase makes it possible to improve the resistance of materials which are subjected to friction to wear and seizure, with respect to hypersilicon alloys. But as a correlative aspect these materials give rise to poor machineability and a very high coefficient of friction. This results in the rapid wear of the opposing component. It is for that reason that in the above-noted Japanese patent application such materials were reserved for the manufacture of components such as, e.g., brake shoes and not engine liners, for the manufacture of which they are completely contra-indicated.

There is therefore a strongly felt need for a process for the production of an aluminum alloy-based material which can be used to produce components for friction applications. There is a strongly felt need for such materials which could be easily machined, which would not produce the rapid wear of the opposing component, and which would be resistant to seizure.

SUMMARY OF THE INVENTION

Accordingly, it is an object of this invention to provide a process for the production of an aluminum alloy-based material which can be used to manufacture components subjected to friction.

It is another object of this invention to provide a process for making an aluminum alloy-based material which can be used to produce components used in friction applications, where the components do not contribute to the rapid wear of opposing components.

It is another object of this invention to provide a process for making an aluminum alloy-based material which can be used to produce components used in friction applications, where the components are resistant to seizure.

It is another object of this invention to provide a process for the production of aluminum alloy-based materials which can be easily machined.

The inventors have now surprisingly discovered that all of the above objects of this invention, and other objects which will become apparent from the discussion below, are satisfied by the process of the present invention. This process relates to a process for the production of a material based on an aluminum alloy, a solid lubricant and at least one ceramic, by powder metallurgy. In this process a ceramic in powder form having a granulometry of between 1 and 10 μm is used.

This invention also relates to an aluminum alloy thus produced.

DETAILED DESCRIPTION OF THE PREFERRED EMBODIMENTS

Without having recourse to the method using calibrated particles of silicon but while retaining the method developed in their patent publication No. 2,343,895, the inventors' aim has been to address the shortcomings of the art; to find a material which affords an optimum compromise between coefficient of friction and resistance to seizure, while maintaining the other properties at a suitable level. They were therefore scarcely encouraged to incorporate ceramics with a high coefficient of friction in a material intended in particular for the manufacture of engine liners. However, wishing nonetheless to enjoy the benefit of certain advantages of such substances, they sought to use them while trying, if not to eliminate the disadvantages, at least to reduce them.

It is in that way that the inventors have now surprisingly found that the solution lay in using a ceramic in powder form with a granulometry of between 1 and 10 μm.

The invention therefore relates to introducing into the mixture of powders formed by the aluminum alloy and the solid lubricant, a ceramic of a granulometry of between 1 and 10 μm, but preferably not exceeding 7 μm. That particular choice of granulometry is due to the surprising discovery made by the inventors, that when using a powder of a decreasing granulometry in the above-indicated range, the coefficient of friction of the material falls, and quite surprisingly, there is no correlative deterioration in the resistance to seizure. To the contrary, there is an improvement in resistance to seizure.

On the other hand, beyond the limits of the above-indicated range, the expected variations in properties are found again. In granulometries which increase beyond 10 μm, there is an increase in the resistance to seizure and the coefficient of friction. In granulometries which decrease below 1 μm, there is then a reduction in such properties.

The above-indicated particular granulometry can be achieved by any known means of atomisation and/or crushing and sieving of the ceramic used.

The ceramic used may be in particular corundum, silicon carbide, zirconia and silica.

The amount of ceramic which gave the best results falls in the range of from 5 to 25% by weight with respect to the final material and preferably between 7 and 15%. Above a value of 25%, it is found that there is a deterioration in the mechanical properties. This could be remedied by carrying out a special treatment involving sintering under a load in the presence of a liquid phase, but this substantially increases the cost of producing the material. Below 5%, the ceramic does not have a sufficient effect.

The materials of the invention may also contain a solid lubricant in a proportion which is lower than 10% of the mass of the final material. Such lubricants can be, for example, molybdenum disulphide, graphite and boron nitride.

The aluminum alloy with which the solid lubricant and the ceramic are mixed may be any alloy available in the form of pre-alloyed or pre-blended powder.

The materials according to the invention are produced and then put into the form of a liner or other component intended to be subjected to friction, as follows. An aluminum alloy powder which is produced by atomisation in air or in an inert gas, with a granulometry of between 20 and 300 μm, is mixed with the solid lubricant. The ceramic with a granulometry of between 1 and 10 μm, is then added and dispersed in the mass of the alloy in as regular a manner as possible, with any known stirring means.

The mixture produced is then compressed in the cold condition either in a uni-axial press or in an isostatic press. It is then hot extruded in an extrusion press in the form of billets or blooms which are machined to the sizes of the desired component or sintered in the hot condition from a blank which is of the appropriate dimensions. Depending on the characteristics desired, the components produced are subjected to thermal treatments such as solution treatment, quenching and tempering.

Other features of the invention will become apparent in the course of the following descriptions of exemplary embodiments which are given for illustration of the invention and are not intended to be limiting thereof.

EXAMPLES

Using a substance formed by a powder of an aluminum alloy of the type A-$U_4$SG, with a granulometry of between 60 and 250 μm, and graphite with a granulometry of between 20 and 100 μm, used in a proportion of 3% by weight with respect to the alloy, eight different blends were produced by adding to four of these 10% corundum with a mean granulometry of respectively 3 - 10 - 20 - 50 μm and, to the other four, 10% of silicon carbide of the same four mean granulometries. The blends were subjected separately firstly to cold compression in a uni-axial press under a pressure of 300 MPa to give blanks of a dimension of 60 mm. Those blanks were extruded at a temperature of 450° C. to give components which were heated at 500° C. for 2 hours and then quenched to 20° C. and finally treated at a tempering temperature of 175° C. for 8 hours.

The eight components produced in that way were then subjected to tests in respect of resistance to seizure on the one hand and measurements of the coefficient of friction on the other hand.

The seizure tests were carried out by means of a PLINT alternating tribometer which is based on the following principle. A metal segment which is displaced with an alternating movement in a straight line is rubbed against a flat, horizontal and lubricated face of the component which is carefully immobilized, and observation is made as to whether seizure does or does not occur.

That test is repeated 10 times on each of the components so as to ensure good measurement reproducibility. A percentage of cases which do not give rise to seizure is deduced therefrom, and it is that parameter which makes it possible to quantify the resistance to seizure. As regards determining the coefficient of friction, that is achieved by means of the same tribometer after lubrication of the component under conditions of limit lubrication and by a measurement by means of a piezoelectric force detector.

The results of the foregoing tests appear in the following two tables. The first table relates to the components containing corundum. The second table relates to the components containing silicon carbide.

TABLE 1

| Mean granulometry $Al_2O_3$ (μm) | Resistance to seizure (in %) | Coefficient of friction |
|---|---|---|
| 3 | 75 | 0.12 |
| 10 | 20 | 0.14 |
| 20 | 25 | 0.16 |
| 50 | 30 | 0.17 |

TABLE 2

| Mean granulometry SiC (μm) | Resistance to seizure (in %) | Coefficient of friction |
|---|---|---|
| 3 | 75 | 0.06 |
| 10 | 50 | 0.10 |
| 20 | 35 | 0.12 |
| 50 | 30 | 0.13 |

The foregoing results show that, contrary to all expectations, the ceramics with a granulometry of 3 μm considerably improve the resistance to seizure in comparison with coarser ceramics. The same also applies with regard to the coefficients of friction so that the effect of the present invention is to provide a variation in a favorable direction of two properties which often vary in opposite directions, while moreover other properties such as machineability, and resistance to wear of the component are also enhanced. This results in the relatively low wear of the opposing component The present invention finds application in the manufacture of components which are subjected to friction such as engine liners. It provides an optimum compromise between the values of the coefficient of friction and the resistance to seizure and wear.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the production of a material based on an aluminum alloy, a solid lubricant, and a ceramic, by powder metallurgy, wherein the said material is imbued with a low coefficient of friction and a high resistance to seizure, said process comprising:

(i) combining an aluminum alloy power, a solid lubricant, and a cermaic, wherein the said ceramic is in powder form and has a granulometry of between 1 μm and 10 μm:

(ii) dispersing the said ceramic in the mass of said alloy;

(iii) compressing the mixture obtained in step (ii); and (iv) extruding the said compressed mixture into billets or blooms.

2. The process of claim 1, comprising using the said ceramic in powder form and having a granulometry between 1 and 7 μm.

3. The process of claim 1, comprising using as the said ceramic at least one member selected from the group consisting of corundums, silicon carbides, zirconias and silicas.

4. The process of claim 1, comprising adding the said ceramic in a proportion of from 5 to 25% by weight with respect to the final material.

5. The process of claim 4, comprising adding the said ceramic in a proportion of from 7 to 15% by weight with respect to the final material.

6. The process of claim 1, comprising using as the said solid lubricant at least one member selected from the group consisting of molybdenum disulphides, graphites and boron nitrides.

7. The process of claim 6, comprising using the said solid lubricant in an amount of less than 10% of the mass of the final material.

8. A material for friction application, wherein the said component is obtained by a process which comprises mixing an aluminum alloy powder, a solid lubricant, and a ceramic, wherein the said ceramic is in powder form and has a granulometry of between 1 μm and 10 μm; and dispersing the said ceramic in the mass of the said alloy.

9. The material of claim 8, wherein the said material is in billet or bloom form.

10. The material of claim 8, wherein the said material is an engine liner.

11. A process for the production of a material based on an aluminum alloy, a solid lubricant, and a ceramic, by powder metallurgy, wherein the said material is imbued with a low coefficient of friction of and a high resistance to seizure, said process comprising:

(i) combining an aluminum alloy powder, a solid lubricant which is at least one member selected from the group consisting of molybdenum disulfides, graphites, and boron nitrides; and a ceramic, wherein the said ceramic is in powder form and has a granulometry of between 1 μm and 10 μm;

(ii) dispersing the said ceramic in the mass of the said alloy;

(iii) compressing the mixture obtained in step (ii); and (iv) extruding the said compressed mixture into billets or blooms.

* * * * *